US009288570B2

(12) United States Patent
Briggs et al.

(10) Patent No.: US 9,288,570 B2
(45) Date of Patent: Mar. 15, 2016

(54) ASSISTING CONVERSATION WHILE LISTENING TO AUDIO

(71) Applicant: Bose Corporation, Framingham, MA (US)

(72) Inventors: Drew Stone Briggs, Jamaica Plain, MA (US); Tristan Edward Taylor, Boston, MA (US)

(73) Assignee: Bose Corporation, Framingham, MA (US)

( * ) Notice: Subject to any disclaimer, the term of this patent is extended or adjusted under 35 U.S.C. 154(b) by 220 days.

(21) Appl. No.: 14/011,171

(22) Filed: Aug. 27, 2013

(65) Prior Publication Data

US 2015/0063601 A1 Mar. 5, 2015

(51) Int. Cl.
*H04R 1/10* (2006.01)

(52) U.S. Cl.
CPC ..... *H04R 1/1091* (2013.01); *H04R 1/1041* (2013.01); *H04R 1/1083* (2013.01); *H04R 2201/107* (2013.01); *H04R 2460/01* (2013.01)

(58) Field of Classification Search
CPC ..... H04R 1/1091; H04R 1/1041
USPC ..... 381/334
See application file for complete search history.

(56) References Cited

U.S. PATENT DOCUMENTS

| | | | | |
|---|---|---|---|---|
| 3,889,059 | A | 6/1975 | Thompson et al. | |
| 3,992,584 | A | 11/1976 | Dugan | |
| 3,999,015 | A | 12/1976 | Snyder et al. | |
| 4,600,208 | A * | 7/1986 | Morishima | 280/288.4 |
| 4,941,187 | A | 7/1990 | Slater | |
| 5,243,659 | A * | 9/1993 | Stafford et al. | 381/86 |
| 5,640,450 | A | 6/1997 | Watanabe | |
| 5,983,183 | A | 11/1999 | Tabet et al. | |
| 6,493,450 | B1 * | 12/2002 | Scheuer et al. | 381/57 |
| 7,065,198 | B2 | 6/2006 | Brown et al. | |

(Continued)

FOREIGN PATENT DOCUMENTS

| | | | |
|---|---|---|---|
| EP | 2555189 | A1 | 2/2013 |
| JP | S57124960 | A | 8/1982 |

(Continued)

OTHER PUBLICATIONS

International Search Report and Written Opinion dated Oct. 2, 2014 for International application No. PCT/US2014/049741.

(Continued)

*Primary Examiner* — Angel Castro

(57) ABSTRACT

A portable system for enhancing communication between users in proximity to each other while listening to a common audio source includes headsets with an electroacoustic transducer for providing sound to a respective user's ear, and a voice microphone for detecting sound of the respective user's voice and providing a microphone input signal, and an electronic device integral to the first headset and in communication with the second headset. The electronic device generates a side-tone signal based on the microphone input signal from the first headset, generates a voice output signal based on the microphone input signal from the first headset, receives a content input signal, combines the side-tone signal with the content input signal and a far-end voice signal associated with the second headset to generate a combined output signal, and provides the combined output signal to the first headset for output by the first headset's transducer.

25 Claims, 2 Drawing Sheets

(56) References Cited

U.S. PATENT DOCUMENTS

| | | | | |
|---|---|---|---|---|
| 7,260,231 | B1 * | 8/2007 | Wedge | 381/310 |
| 7,620,419 | B1 * | 11/2009 | Gandolfo | 455/556.1 |
| 7,627,352 | B2 | 12/2009 | Gauger, Jr. et al. | |
| 8,139,744 | B2 | 3/2012 | Carlson et al. | |
| 8,208,650 | B2 | 6/2012 | Joho et al. | |
| 8,363,820 | B1 | 1/2013 | Graham | |
| 2002/0059064 | A1 * | 5/2002 | Tabata et al. | 704/225 |
| 2003/0118197 | A1 | 6/2003 | Nagayasu et al. | |
| 2005/0282592 | A1 | 12/2005 | Frerking et al. | |
| 2006/0293092 | A1 * | 12/2006 | Yard et al. | 455/575.2 |
| 2008/0037749 | A1 | 2/2008 | Metzger et al. | |
| 2008/0201138 | A1 | 8/2008 | Visser et al. | |
| 2009/0023417 | A1 * | 1/2009 | Davis et al. | 455/403 |
| 2010/0119077 | A1 | 5/2010 | Platz et al. | |
| 2010/0150383 | A1 | 6/2010 | Sampat | |
| 2011/0033064 | A1 | 2/2011 | Johnson et al. | |
| 2011/0044474 | A1 | 2/2011 | Grover et al. | |
| 2011/0135086 | A1 | 6/2011 | Sun et al. | |
| 2011/0288860 | A1 | 11/2011 | Schevciw et al. | |
| 2011/0293103 | A1 | 12/2011 | Park et al. | |
| 2012/0140941 | A1 | 6/2012 | Kuhtz et al. | |

FOREIGN PATENT DOCUMENTS

| | | | |
|---|---|---|---|
| WO | 9911045 | A1 | 3/1999 |
| WO | 9911047 | A1 | 3/1999 |
| WO | 200997009 | A1 | 8/2009 |

OTHER PUBLICATIONS

International Search Report and Written Opinion dated Oct. 27, 2014 for International application No. PCT/US2014/049750.

* cited by examiner

ASSISTING CONVERSATION WHILE LISTENING TO AUDIO

BACKGROUND

This disclosure relates to assisting conversation while listening to music, and in particular, to allowing two or more headset users near each other to listen to music, or some other audio source, while at the same time being able to speak with ease and hear each other with ease, to carry on a conversation naturally over the audio content.

Carrying on a conversation while listening to some other audio source, such as discussing a musical performance while simultaneously listening to that performance, can be very difficult. In particular, the person speaking has trouble hearing their own voice, and must raise it above what may be a comfortable level just to hear themselves, let alone for the other person to hear them over the music. The speaker may also have difficulty gauging how loudly to speak to allow the other person to hear them. Likewise, the person listening must strain to hear the person speaking, and to pick out what was said. Even with raised voices, intelligibility and listening ease suffer. Additionally, speaking loudly can disturb others nearby, and reduce privacy.

Various solutions have been attempted to reduce these problems in other contexts, such as carrying on a conversation in a noisy environment. Hearing aids intended for those with hearing loss often have directional modes which attempt to amplify the voice of a person speaking to the user while rejecting unwanted noise, but they suffer from poor signal-to-noise ratio due to limitations of the microphone being located at the ear of the listener. Also, hearing aids provide only a listening benefit, and do not address the discomfort of straining to speak loudly in noise, let alone in coordination with shared audio sources. Other communication systems, such as noise-canceling, intercom-connected headsets for use by pilots, may be quite effective for their application, but are tethered to the dashboard intercom, and are not suitable for use by typical consumers in social or mobile environments or, even in an aircraft environment, i.e., by commercial passengers.

SUMMARY

In general, in one aspect, a portable system for enhancing communication between at least two users in proximity to each other while listening to a common audio source includes first and second headsets, each headset including an electroacoustic transducer for providing sound to a respective user's ear, and a voice microphone for detecting sound of the respective user's voice and providing a microphone input signal, and a first electronic device integral to the first headset and in communication with the second headset. The first electronic device generates a first side-tone signal based on the microphone input signal from the first headset, generates a first voice output signal based on the microphone input signal from the first headset, receives a content input signal, combines the first side-tone signal with the content input signal and a first far-end voice signal associated with the second headset to generate a first combined output signal, and provides the first combined output signal to the first headset for output by the first headset's electroacoustic transducer.

Implementations may include one or more of the following, in any combination. The first electronic device may scale the first side-tone signal to control the level at which the user speaks. The first electronic device may scale the first side-tone signal based in part on a detected level of ambient noise, such that the user speaks at a level unlikely to be audible over the ambient noise without assistance. The first electronic device may scale the first side-tone signal based in part on a detected level of ambient noise, such that the user speaks at a level likely to be masked by the ambient noise. The first electronic device may scale the first side-tone signal such that the user speaks at a level unlikely to be audible without assistance at a distance from the user of more than a meter.

The first electronic device may be coupled directly to the second headset, and the first electronic device may generate a second side-tone signal based on the microphone input signal from the second headset, generate the first far-end voice signal based on the microphone input signal from the second headset, combine the second side-tone signal with the content input signal and the first voice output signal to generate a second combined output signal, and provide the second combined output signal to the second headset for output by the second headset's electroacoustic transducer. The first electronic device may include the content input signal in the first and second combined output signals by scaling the content input signal to be sufficiently lower in level than the first and second side-tone signals and first and second far-end voice output signals such that the side-tone signals and far-end voice signals remain intelligible over the content signal. The step of scaling the content input signal may be performed only when one of the microphone input signals from at least one of the first or second headsets is above a threshold. A second electronic device may be integral to the second headset, the first electronic device in communication with the second headset through the second electronic device, and the second electronic device may generate a second side-tone signal based on the microphone input signal from the second headset, generate a second voice output signal based on the microphone input signal from the second headset, provide the second voice output signal to the first electronic device as the first far-end voice signal, receive the first voice output signal from the first electronic device as a second far-end voice signal, receive the content input signal, combine the second side-tone signal with the content input signal and the second far-end voice signal to generate a second combined output signal, and provide the second combined output signal to the second headset for output by the second headset's electroacoustic transducer.

The first electronic device and the second electronic device may include the content input signal in the respective first and second combined output signals by each scaling the content input signal to be sufficiently lower in level than the first and second side-tone signals and first and second far-end voice output signals such that the side-tone signals and far-end voice signals remain intelligible over the content signal. The step of scaling the content input signal may be performed by both the first electronic device and the second electronic device whenever the microphone input signal from either one of the first or second headsets may be above a threshold. The first and second headsets may each include a noise cancellation circuit including a noise cancellation microphone for providing anti-noise signals to the respective electroacoustic transducer based on the noise cancellation microphone's output, and the first electronic device may provide the first combined output signal to the first headset for output by the first headset's electroacoustic transducer in combination with the anti-noise signals provided by the first headsets's noise cancellation circuit. The first and second headsets may each include passive noise reducing structures. Generating the first side-tone signal may include applying a frequency-dependent gain to the microphone input signal from the first headset. Generating the first side-tone signal may include filtering the microphone input signal from the first headset and applying a gain to the filtered signal. The first electronic device may include a source of the content input signal. The content input signal may be received wirelessly.

In general, in one aspect, a headset includes an electroacoustic transducer for providing sound to a user's ear, a voice microphone for detecting sound of the user's voice and providing a microphone input signal, and an electronic device that generates a side-tone signal based on the microphone input signal from the headset, generates a voice output signal based on the microphone input signal from the headset, receives a content input signal, receives a far-end voice signal associated with another headset, combines the side-tone signal with the content input signal and the far-end voice signal to generate a combined output signal, outputs the combined output signal to the electroacoustic transducer, and outputs the voice output signal to the other headset.

Implementations may include one or more of the following, in any combination. The electronic device may scale the side-tone signal to control the level at which the user speaks. The electronic device may scale the side-tone signal based in part on a detected level of ambient noise, such that the user speaks at a level unlikely to be audible over the ambient noise without assistance. The electronic device may scale the side-tone signal based in part on a detected level of ambient noise, such that the user speaks at a level likely to be masked by the ambient noise. The electronic device may scale side-tone signal such that the user speaks at a level unlikely to be audible without assistance at a distance from the user of more than a meter. The headset may include a source of the content input signal, and may provide the content input signal to the other headset. The electronic device may provide the content input signal to the other headset by combining the content input signal with the voice output signal. The electronic device may provide the content input signal to the other headset separately from outputting the voice output signal.

Advantages include allowing users to discuss shared audio content, such as music, a movie, or other content without straining to hear to be heard over the content or over other background noise. Privacy is improved because users don't have to speak so loudly to be heard that other can also hear them over the background noise. Users are also enabled to discuss shared audio content in a quiet environment without bothering others or compromising privacy, as they can speak softly without straining to head each other over the shared content.

All examples and features mentioned above can be combined in any technically possible way. Other features and advantages will be apparent from the description and the claims.

DESCRIPTION

Figure 1:
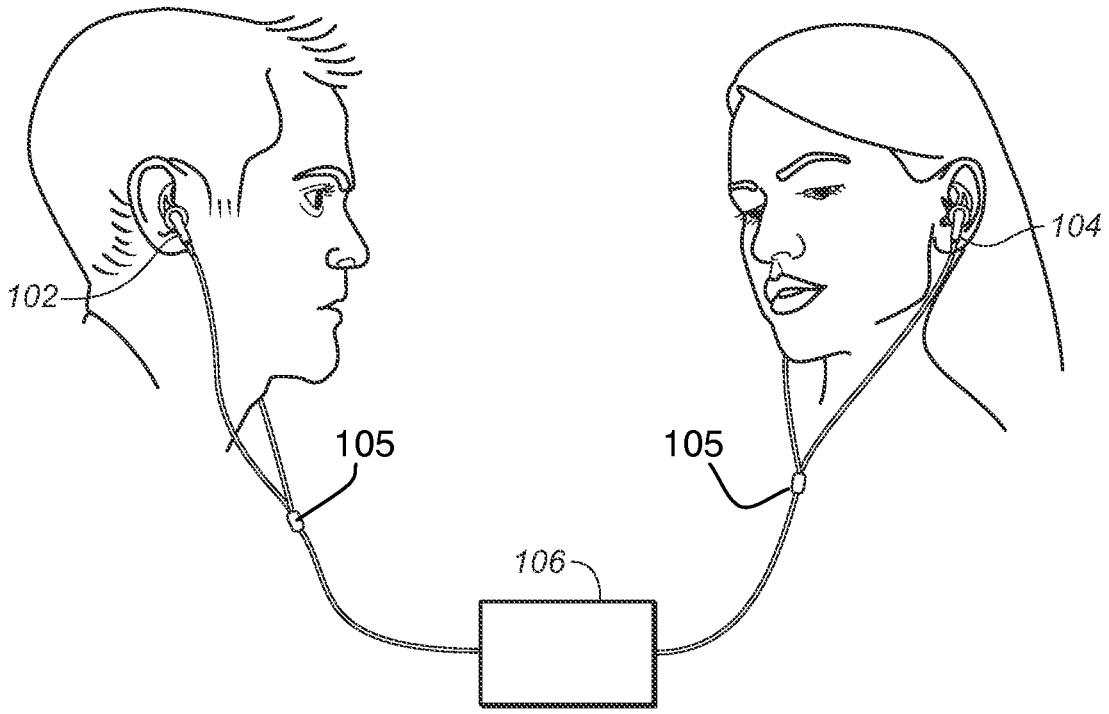
FIGS. 1 and 2 show configurations of headsets and electronic devices used in conversations.
Figure 2:
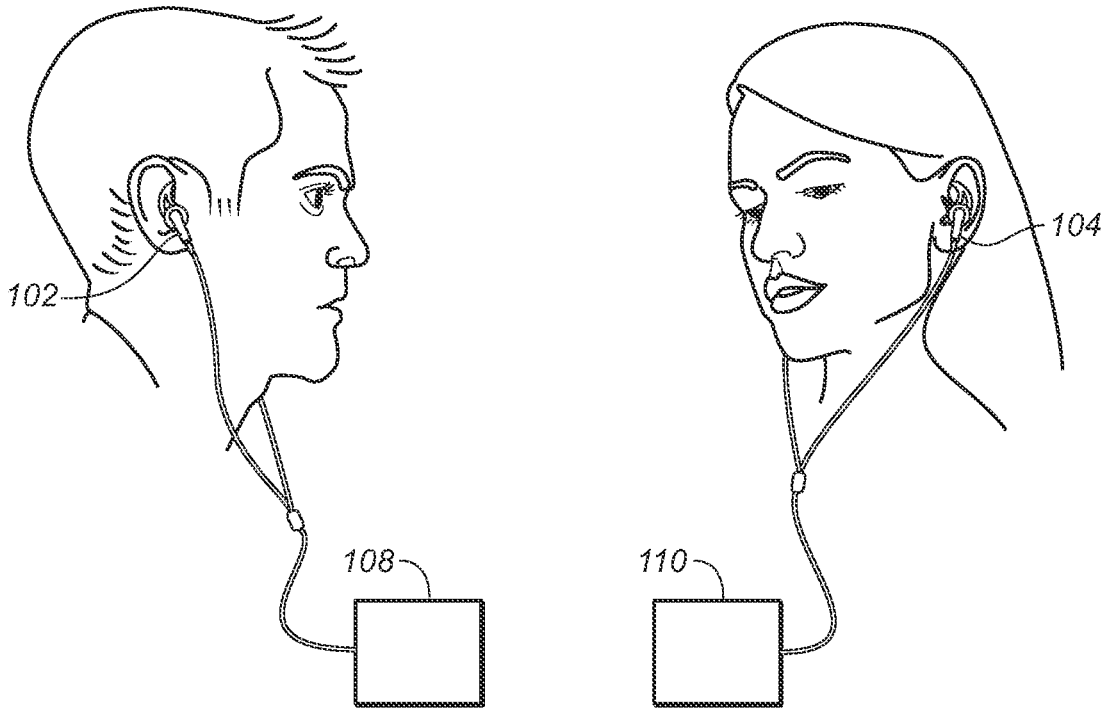

The system described here allows two or more users to listen to a common audio source, such as recorded or streamed music or the audio from a movie, to name some examples, while carrying on a conversation. While the intent is that the conversation be about the music, users are likely, of course, to discuss anything they feel like. The goal of the system is to allow the users to carry on their conversation without having to strain to speak, to hear each other or the music, and to be understood. We refer to music, but of course any audio content could be used. U.S. patent application Ser. No. 14/011,161, by Kathy Krisch and Steve Isabelle, titled "Assisting Conversation," was filed simultaneously and is incorporated here by reference in its entirety. That application describes a portable system for assisting conversation in general by managing filters and gains applied to both a side-tone signal and one or more of an outgoing voice signal and an incoming far-end voice signal for each of two or more headset users. FIGS. 1 and 2 are reproduced from that application and show two users of headsets 102 and 104 conversing. In FIG. 1, the two headsets are connected to a common electronic device 106, while in FIG. 2, each headset is connected to its own associated electronic device 108 or 110. In general, the electronic devices may be integral to the headsets, either embedded in the ear buds or in-line with a cable. Alternatively, the electronic devices may be separate devices, such as mobile phones. Each headset includes a microphone 105, which may be in the cable, as shown, integrated into one or both ear buds, or on a boom supported from one ear.

Figure 3:
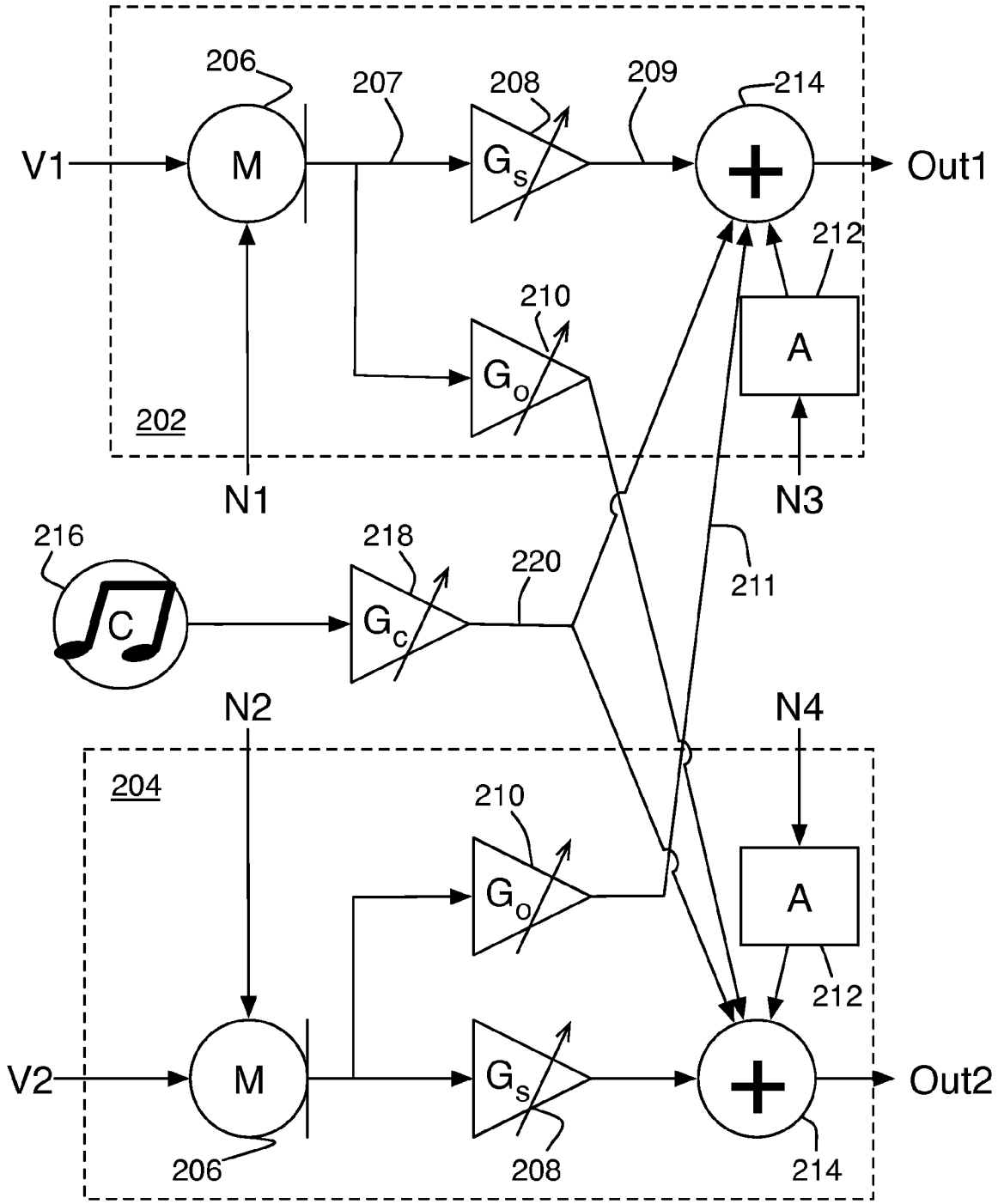
FIG. 3 shows a circuit for implementing the devices of FIGS. 1 and 2.

FIG. 3 shows an additional feature of this application added to the system of the Krisch application. Each of the combined electronic and acoustic systems 202, 204 includes a voice microphone 206, side-tone gain stage 208, a voice output gain stage 210, an attenuation block 212, and a summing node 214. The voice microphones detect the voice of their users as voice audio inputs V1 and V2, and provide a microphone input signal 207. The microphones 206 also detect ambient noise N1 and N2 and pass that on to the gain stages, filtered according to the microphone's noise rejection capabilities. The microphones are more sensitive to the voice input than to ambient noise, by a noise rejection ratio M, thus the microphone input signals are represented as V1+N1/M and V2+N2/M. Within those signals, N1/M and N2/M represent unwanted background noise. Different ambient noise signals N1 and N2 are shown entering the two systems, but depending on the distance between the users and the acoustic environment, the noises may be effectively the same. Ambient noises N3 and N4 at the users ears, which may also be the same as N1 or N2, are attenuated by the attenuation block 212 in each circuit, which represents the combined passive and active noise reduction capability, if any, of the headsets. The residual noise is shown entering the output summation node, though in actual implementation, the electronic signals are first summed and output by the output transducer, and the output of the transducer is acoustically combined with the residual noise within the user's ear canal. That is, the output node 214 represents the output transducer in combination with its acoustic environment. Out1 and Out2 represent the total audio output of the system, including the attenuated ambient noise.

The side-tone gain stage 208 applies a filter and gain to the microphone input signal to change the shape and level of the voice signal to optimize it for use as a side-tone signal 209. When a person cannot hear his own voice, such as when listening to other sounds, he will tend to speak more loudly. This has the effect of straining the speaker's voice. On the other hand, if a person is wearing noise isolating or noise canceling headphones, he will tend to speak at a comfortable, quieter level, but also will suffer from the occlusion effect, which inhibits natural, comfortable speaking. The occlusion effect is when ear canal resonances and bone conduction result in distortion and low-frequency amplification, and causes a person's voice to sound unnatural to themselves. A side-tone signal is a signal played back to the ear of the speaker, so that he can hear his own voice. If the side-tone signal is appropriately scaled, the speaker will intuitively control the level of his voice to a comfortable level, and be able to speak naturally. The side-tone filter within the gain stage 208 shapes the voice signal to compensate for the way the occlusion effect changes the sound of a speaker's voice when his ear is plugged, so that in addition to being at the appropriate level, the side-tone signal sounds, to the user, like his actual voice sounds when not wearing a headset. We represent the side tone filter as part of frequency-dependent side tone gain $G_s$.

The microphone input signal 207 is also equalized and scaled by the voice output gain stage 210, applying a frequency-dependent voice output gain $G_0$ that incorporates a voice output filter. The voice output filter and gain are selected to make the voice signal from one headset's microphone audible and intelligible to the user of the second headset, when played back in the second headset. The filtered and scaled voice output signals 211 are each delivered to the other headset, where they are combined with the filtered and scaled side-tone signals 209 within each headset and the residual ambient noise to produce a combined audio output Out1 or Out2. When discussing one headset, we may refer to the voice output signal 211 from the other headset, played back by the headset under consideration, as the far-end voice signal. In some examples, the incoming far-end voice signal may be filtered and amplified within each headset, in place of or in addition to filtering and amplifying the voice output signal.

To allow the users of the headsets to hear and discuss a common audio signal, a side-channel provides additional audio content C to the headsets. A gain stage 218 applies a frequency-dependent gain $G_c$ to the content C from the content source 216, providing a content input signal 220 and adding an additional term $G_cC$ to each of the audio outputs. As with the other gain stages, gain $G_c$ may specifically be frequency-dependent, or the input path may include a filter to shape the audio signal C in combination with applying a flat gain. The content may be received or generated by one of the headsets and transmitted to the other headset, or it may be independently received at both headsets. If the content is received at one headset and transmitted to the other, the gain $G_c$ may be applied at the transmitting headset for both headsets, or it may be applied to the received content signal at each headset, allowing the variation and customization shown in the Krisch application. The gain(s) $G_c$ are designed in consideration of the voice signals and voice gains to allow the content to be heard at a level that does not mask the voice signals, both far-end and side-tone, such that the voices can be heard over the audio content. Providing a single content input signal to both headsets allows the two users to listen to the same content, while also being able to speak with each other. This can allow, for example, two users to share a single piece of music, and discuss it amongst themselves, with the various gains allowing them to hear themselves and each other over the music. The gains may be adjusted automatically, such that the music is attenuated to avoid masking voice when either of the users is speaking, but is returned to a normal listening level when neither is speaking. FIG. 3 shows the content source 216 external to both electronic circuits 202 and 204. In some examples, the content source may be integrated into one of the circuits, or in the electronic device housing one of the circuits, and the content input signal 220 is provided to the other circuit via an output from the first electronic device coupled to an input of the second electronic device housing the second circuit.

In some examples, it may be desirable for the user to speak softly, relying on the communication system to deliver his voice to a conversation partner at an appropriate level. In this situation, the side-tone signal may be amplified, so that the user hears his voice at a normal speaking level, despite speaking softly. For a fully private conversation in a quiet environment, the side-tone level may be set such that the user's voice can be detected by the microphone, but is unlikely to be audible by an unassisted person more than a meter away. The precise level used will also be based on the level of the audio input, discussed below, so that the combined effect of the audio level and the side-tone level lead to the desired spoken voice level. In a noisy environment, the user may need to speak at a louder level to be detected by the microphone, so the side-tone signal is again appropriately scaled so that the combination of side-tone level and audio content level lead the user to speaking at a level that provides sufficient signal to the conversation system, but without causing the user to strain to be heard over the background noise. This has the added advantage of the user not having to speak so loudly that other nearby users can also hear the conversation over the background noise, as the background noise will mask a speaking level that can still be detected by the microphone.

For conversation enhancement, the Krisch application assumes that the headsets are attenuating, at least passively if not actively. In contrast, for music sharing, it may be desirable that the headsets be non-attenuating, or open. Open headsets provide minimal passive attenuation of ambient sounds. In a quiet environment, this is believed by some to improve the quality of music playback. When the present invention is employed with open headsets, changes may be made to the various filters and gains. In particular, a user may not need a side-tone signal at all, as his own voice can travel to his ear naturally, and the ear canal is not blocked, so their is no occlusion effect. The masking effect of the audio content C is still present however, so some amount of side tone may be desired to allow the user to speak at an appropriate level over the audio content. The side-tone may also still be useful for controlling the level of the user's voice relative to any background noise. The voice output/far-end voice signal gain is also modified, to account for the different acoustics of the open headset. Overall, the goal remains the same—to allow the users to hear each other, without straining to speak or to hear, while still hearing the audio content at an enjoyable level.

In either case, for attenuating or open headsets, the content gain $G_c$ is selected to make the audio content C loud enough to be enjoyed by both users, while not so loud that the other gains need to be raised to uncomfortable levels to allow conversation. This will generally be a lower level than would be used for simple audio playback. In some examples, the gain $G_c$ is switched between two levels, one for conversation and the other for listening, automatically, triggered by the users talking. Thus, the content will be "ducked," but not completely muted, when the users are speaking, and will return to its normal level after they stop. Generally, it would be desirable that the ducking be stated very quickly, but the gain be raised back to the listening level more gradually, so that it is not constantly jumping up and down at every lull in the conversation.

Another application of the system described here is to provide a conversation channel amongst participants in a silent disco. In a silent disco, a large number of participants listen to a distributed audio signal over personal wireless listening devices, such as wireless headsets or headphones connected to mobile phones. The system described herein may use the silent disco audio feed as the audio content source 216, while allowing a subset of the participants to connect to each other for conversation in parallel with the shared music.

Embodiments of the systems and methods described above comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other embodiments are within the scope of the following claims.

What is claimed is:

1. A portable system for enhancing communication between at least two users in proximity to each other while listening to a common audio source, comprising:

first and second headsets, each headset comprising:

an electroacoustic transducer for providing sound to a respective user's ear, and a voice microphone for detecting sound of the respective user's voice and providing a microphone input signal; and a first electronic device integral to the first headset and in communication with the second headset, configured to:

generate a first side-tone signal based on the microphone input signal from the first headset, generate a first voice output signal based on the microphone input signal from the first headset, receive a content input signal, receive a first far-end voice signal from the second headset, combine the first side-tone signal with the content input signal and the first far-end voice signal to generate a first combined output signal, and provide the first combined output signal to the first headset for output by the first headset's electroacoustic transducer.

2. The system of claim 1 wherein the first electronic device scales the first side-tone signal independently of the content input signal and the first far-end voice signal to control the level at which the user speaks.

3. The system of claim 2 wherein the first electronic device scales the first side-tone signal based in part on a detected level of ambient noise, such that the user speaks at a level unlikely to be audible over the ambient noise without assistance.

4. The system of claim 2 wherein the first electronic device scales the first side-tone signal based in part on a detected level of ambient noise, such that the user speaks at a level likely to be masked by the ambient noise.

5. The system of claim 2 wherein the first electronic device scales the first side-tone signal such that the user speaks at a level unlikely to be audible without assistance at a distance from the user of more than a meter.

6. The system of claim 1 wherein the first electronic device is coupled directly to the second headset, and the first electronic device is further configured to:

generate a second side-tone signal based on the microphone input signal from the second headset, generate the first far-end voice signal based on the microphone input signal from the second headset, combine the second side-tone signal with the content input signal and the first voice output signal to generate a second combined output signal, and provide the second combined output signal to the second headset for output by the second headset's electroacoustic transducer.

7. The system of claim 6 wherein the first electronic device includes the content input signal in the first and second combined output signals by scaling the content input signal to be sufficiently lower in level than the first and second side-tone signals and first and second far-end voice output signals such that the side-tone signals and far-end voice signals remain intelligible over the content signal.

8. The system of claim 7 wherein the step of scaling the content input signal is performed only when one of the microphone input signals from at least one of the first or second headsets is above a threshold.

9. The system of claim 1 further comprising a second electronic device integral to the second headset, wherein the first electronic device is in communication with the second headset through the second electronic device, and the second electronic device is configured to:

generate a second side-tone signal based on the microphone input signal from the second headset, generate a second voice output signal based on the microphone input signal from the second headset, provide the second voice output signal to the first electronic device as the first far-end voice signal, receive the first voice output signal from the first electronic device as a second far-end voice signal, receive the content input signal, combine the second side-tone signal with the content input signal and the second far-end voice signal to generate a second combined output signal, and provide the second combined output signal to the second headset for output by the second headset's electroacoustic transducer.

10. The system of claim 9 wherein the first electronic device and the second electronic device include the content input signal in the respective first and second combined output signals by each scaling the content input signal to be sufficiently lower in level than the first and second side-tone signals and first and second far-end voice output signals such that the side-tone signals and far-end voice signals remain intelligible over the content signal.

11. The system of claim 10 wherein the step of scaling the content input signal is performed by both the first electronic device and the second electronic device whenever the microphone input signal from either one of the first or second headsets is above a threshold.

12. The system of claim 1, wherein the first and second headsets each include a noise cancellation circuit including a noise cancellation microphone for providing anti-noise signals to the respective electroacoustic transducer based on the noise cancellation microphone's output, and the first electronic device is configured to provide the first combined output signal to the first headset for output by the first headset's electroacoustic transducer in combination with the anti-noise signals provided by the first headsets's noise cancellation circuit.

13. The system of claim 1, wherein the first and second headsets each include passive noise reducing structures.

14. The system of claim 1 wherein generating the first side-tone signal includes applying a frequency-dependent gain to the microphone input signal from the first headset.

15. The system of claim 1 wherein generating the first side-tone signal includes filtering the microphone input signal from the first headset and applying a gain to the filtered signal.

16. The system of claim 1 wherein the first electronic device further includes a source of the content input signal.

17. The system of claim 1 wherein the content input signal is received wirelessly.

18. A headset comprising:

an electroacoustic transducer for providing sound to a user's ear;

a voice microphone for detecting sound of the user's voice and providing a microphone input signal; and an electronic device, configured to:

generate a side-tone signal based on the microphone input signal from the headset, generate a voice output signal based on the microphone input signal from the headset, receive a content input signal, receive a far-end voice signal associated with another headset, combine the side-tone signal with the content input signal and the far-end voice signal to generate a combined output signal, output the combined output signal to the electroacoustic transducer, and output the voice output signal to the other headset.

19. The headset of claim 18 wherein the electronic device scales the side-tone signal independently of the content input signal and the first far-end voice signal to control the level at which the user speaks.

20. The headset of claim 19 wherein the electronic device scales the side-tone signal based in part on a detected level of ambient noise, such that the user speaks at a level unlikely to be audible over the ambient noise without assistance.

21. The headset of claim 19 wherein the electronic device scales the side-tone signal based in part on a detected level of ambient noise, such that the user speaks at a level likely to be masked by the ambient noise.

22. The headset of claim 19 wherein the electronic device scales the side-tone signal such that the user speaks at a level unlikely to be audible without assistance at a distance from the user of more than a meter.

23. The headset of claim 18 further comprising a source of the content input signal, and wherein the electronic device is configured to provide the content input signal to the other headset.

24. The headset of claim 23 wherein the electronic device provides the content input signal to the other headset by combining the content input signal with the voice output signal.

25. The headset of claim 23 wherein the electronic device provides the content input signal to the other headset separately from outputting the voice output signal.

* * * * *